US011123991B2

(12) United States Patent
Gracia Verdugo et al.

(10) Patent No.: US 11,123,991 B2
(45) Date of Patent: Sep. 21, 2021

(54) WEIGHT PARAMETERS OF PRINT AGENT DROPS

(71) Applicant: Hewlett-Packard Development Company, L.P., Houston, TX (US)

(72) Inventors: Antonio Gracia Verdugo, Sant Cugat del Valles (ES); Diana Pilar Pascual Soldevilla, Sant Cugat del Valles (ES); Sara Echevarria Benito, Sant Cugat del Valles (ES); David Toussaint, Sant Cugat del Valles (ES); Mauricio Seras Franzoso, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 370 days.

(21) Appl. No.: 16/305,110

(22) PCT Filed: Jul. 28, 2016

(86) PCT No.: PCT/US2016/044507
§ 371 (c)(1),
(2) Date: Nov. 28, 2018

(87) PCT Pub. No.: WO2018/022066
PCT Pub. Date: Feb. 1, 2018

(65) Prior Publication Data

US 2020/0324550 A1 Oct. 15, 2020

(51) Int. Cl.
*B41J 2/165* (2006.01)
*B41J 2/125* (2006.01)

(52) U.S. Cl.
CPC ..... *B41J 2/16579* (2013.01); *B41J 2/125* (2013.01)

(58) Field of Classification Search
CPC ..... B41J 2/16579; B41J 2/125; B41J 29/393; B41J 2/165
See application file for complete search history.

(56) References Cited

U.S. PATENT DOCUMENTS

| | | | |
|---|---|---|---|
| 6,247,776 | B1 | 6/2001 | Usui et al. |
| 6,517,175 | B2 | 2/2003 | Kanaya et al. |
| 8,708,442 | B2 | 4/2014 | Baldy, Jr. et al. |
| 8,783,806 | B2 | 7/2014 | Abergel |
| 9,102,142 | B2 * | 8/2015 | Gracia Verdugo ..... B41J 2/2142 |
| 9,134,233 | B2 | 9/2015 | Taff et al. |
| 9,302,519 | B1 | 4/2016 | Clark et al. |
| 2010/0101493 | A1 | 4/2010 | Hodge et al. |
| 2010/0214597 | A1 | 8/2010 | Hasseler et al. |
| 2014/0098156 | A1 | 4/2014 | Taff et al. |
| 2014/0210889 | A1 | 7/2014 | Gracia Verdugo et al. |
| 2015/0097884 | A1 | 4/2015 | Kearl et al. |
| 2015/0197085 | A1 | 7/2015 | Panchawagh et al. |

OTHER PUBLICATIONS

Hankins, A., "Novel Ink Drop Watcher", Oct. 2009 106 pages.
(Continued)

*Primary Examiner* — Huan H Tran
(74) *Attorney, Agent, or Firm* — "HP Inc. Patent Departmeut"

(57) ABSTRACT

In an example, a method includes ejecting a print agent drop from a printhead, and determining an indication of velocity of the print agent drop. A weight parameter of the print agent drop may be determined from the indication of velocity.

20 Claims, 6 Drawing Sheets

(56) References Cited

OTHER PUBLICATIONS

Mills, R., et al, "Drop Placement Error Analysis for Ink Jet Deposition", Ingenta Connect, Jan. 1, 2006, 2 pages.
Mitsuhashi, T., et al., "New Technologies of the Inkjet Textile Printing System—Nassenger-V", Apr. 26, 2005, 4 pages.
Unknown, "Vision System Monitors Ink Jets", Vision Systems Design, Sep. 1, 2008, 3 pages.

* cited by examiner

WEIGHT PARAMETERS OF PRINT AGENT DROPS

BACKGROUND

Print apparatus utilise various techniques to disperse print agents such as coloring agent (for example comprising an ink, dye or colorant), coatings, heat absorbing agents or the like. Such apparatus may comprise a printhead. An example printhead includes a set of nozzles and a mechanism for ejecting a selected agent as a fluid, for example a liquid, through a nozzle. In such examples, a drop detector may be used to detect whether drops are being ejected from individual nozzles of a printhead. For example, a drop detector may be used to determine whether any of the nozzles are dogged and would benefit from cleaning or whether individual nozzles have failed permanently.

BRIEF DESCRIPTION OF DRAWINGS

Non-limiting examples will now be described with reference to the accompanying drawings, in which.

DETAILED DESCRIPTION

Figure 1:
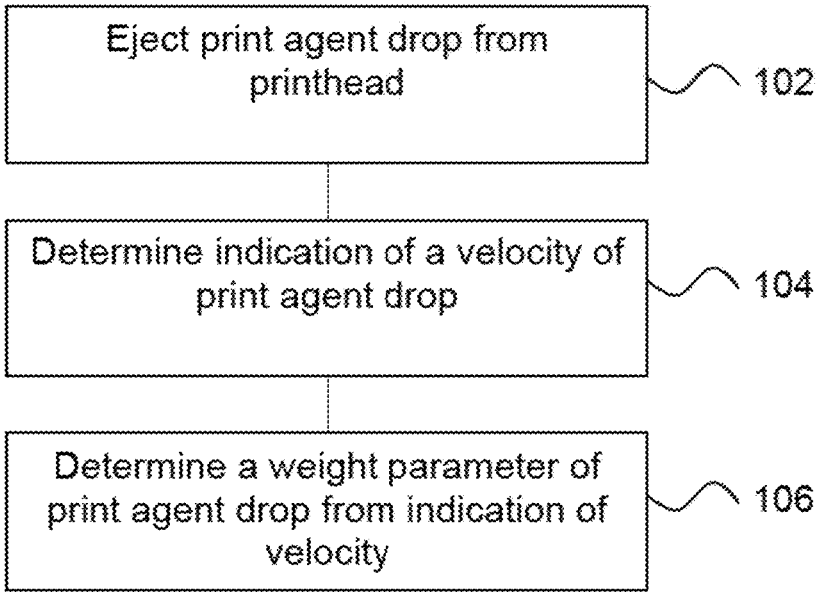
FIG. 1 is a flowchart of an example method of determining a weight parameter of the ink drop.

FIG. 1 is a method comprising, in block 102, ejecting a print agent drop from a printhead. In some examples, the printhead may be an inkjet printhead, for example, a thermal inkjet printhead. The printhead may be for use in a two-dimensional printing operation (for example, printing onto a substrate such as paper, card, plastic, metal or the like) or a three dimensional printing operation (for example printing onto a layer of build material to cause selective fusion thereof in so-called additive manufacturing). In some such examples, the print agent may comprise a heat absorbing agent. Block 104 comprises determining an indication of a velocity of the ejected print agent drop. In some examples, this is determined while the print agent drop is travelling towards a substrate. For example, this may comprise determining the time of arrival of a print agent drop in a sampling volume. Block 106 comprises determining a weight parameter of the print agent drop from the indication of velocity.

The weight parameter may be an indication of the weight of the print agent drop. A drop of print agent dispensed from a printhead has a momentum. The heavier the drop, the higher the momentum and therefore the more quickly the ink drop falls. In addition, according to Stokes law, bigger drops are less deflected by air. Although bigger drops experience more air friction, they also have a higher velocity due to gravitational effects. Thus the velocity of an ink drop is correlated to its weight. While the relationship between velocity and weight may be determined theoretically, in some examples, the relationship between drop weight and drop velocity for a particular fluid may be, or have been, experimentally determined and stored as a look up table. In another example, a predetermined relationship may be recorded in an algorithm.

In some examples, rather than being an indication of the absolute weight, the weight parameter may be a difference between an anticipated weight and a determined weight. In some examples, the weight parameter may comprise a difference between an anticipated velocity and the determined velocity, i.e., where there is an established relationship between velocity and weight, the weight parameter may be expressed in terms of velocity. In some examples, the weight parameter may be expressed as a volume.

Determining a weight parameter may in turn allow other information to be derived. For example, if a drop is lighter than expected, this may indicate a partial blockage or 'kogation' of a printhead nozzle. In some inkjet print apparatus, for example, in thermal inkjet printers, a resistor is used to provide a heating element, and over time components of the print agent may accumulate on the resistor, reducing thermal emissions, making them less energy-efficient, and reducing the volume and velocity of drops fired. This effect can be particularly prevalent in multipass printing methods where a 'ramp' is applied to the amount of print agent ejected across a row of nozzles. As boundary areas may pass under the nozzles on more than one pass, such printing methods may eject less print agent from nozzles toward the ends of a printhead than from the nozzles toward the centre of the printhead to have smoother transitions within the boundary areas. With different levels of usage of the nozzles across the printhead, differing levels of kogation can occur across the nozzles of a printhead.

Kogation can have an impact on image quality and may also result in an over-estimation of print agent usage. A print apparatus may operate on the assumption that print agent drops of a particular size are being ejected, where as in fact, due to kogation or partial blockage, the print agent drops are smaller than anticipated and, as a result, the reserves of print agent may be higher than anticipated. Unless this is taken into account, a user may be told that print agent reserves have been used up when in fact this is not the case.

Figure 2:
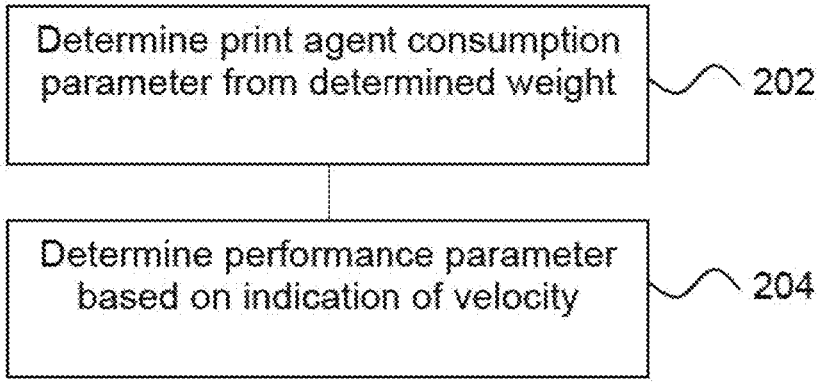
FIG. 2 is a flowchart of an example method of determining an ink consumption and a performance parameter.

FIG. 2 is an example of a method which may follow blocks 102-106 of FIG. 1. In block 202, a print agent consumption parameter is determined from the determined weight. This may for example comprise an indication of the actual drop weight, or may comprise a correction factor which is applied to a predetermined print agent consumption parameter. The predetermined print agent consumption parameter may for example be based on an assumption that each print agent drop is being dispensed from a fully functional or 'healthy' nozzle, and therefore has a particular size and/or momentum. In some print apparatus, the drop size may be controlled, for example to achieve a particular print effects or to compensate for kogation. In such examples, the voltage used to eject print agent drops may for example be increased to increase drop size, or the drop size may be controlled in some other way. Thus, in some examples, an anticipated weight for a print agent drop may be determined for a print agent drop dispensed under particular conditions.

Block 204 comprises determining a performance parameter for a nozzle of the printhead based on the indication of velocity. For example, a nozzle may be scored based on the speed with which a drop is ejected, with lower speeds being indicative of kogation or partial blockage and therefore indicating a poor performance. This information may for example allow a user (or a print apparatus, on an automatic basis) to take action, such as performing a cleaning operation or replacing a printhead, or may allow compensation algorithms to be used (for example, nozzle(s) adjacent to a nozzle exhibiting poor performance may be used more frequently than the poorly performing nozzle).

Figure 3:
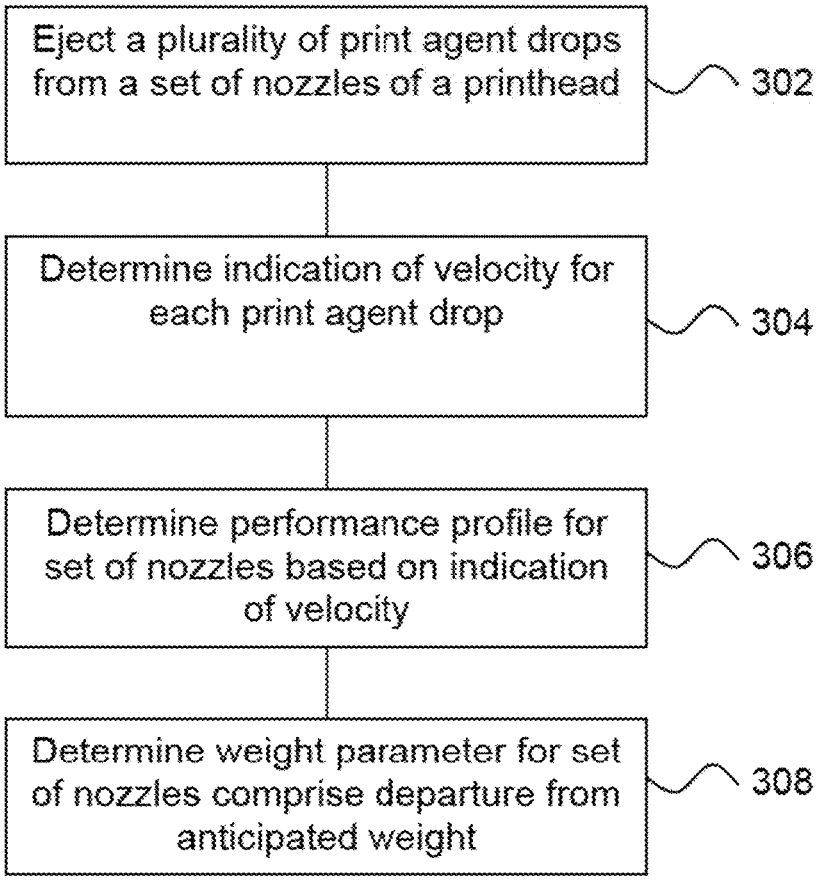
FIG. 3 is a flowchart of an example method of determining a performance profile and a weight parameter for a set of nozzles.

FIG. 3 is an example of a method comprising, in block 302, ejecting a plurality of print agent drops. Each print agent drop is ejected from a nozzle of a set of nozzles of a printhead. Block 304 comprises determining, for each print agent drop, an indication of velocity. This may comprise determining the difference between an anticipated drop arrival time and a measured drop arrival time. The anticipated arrival time may for example be the anticipated arrival time of a drop ejected from a fully functional nozzle. Block 306 comprises determining (for example using processing circuitry) a performance profile for the set of nozzles based on the indication of velocity and block 308 comprises determining, for the set of nozzles, a weight parameter comprising an average departure from an anticipated weight of a print agent drop (or the cumulative anticipated weights of the print agent drops across the set of nozzles if the weight of ink to be dispensed from the nozzles is expected to differ). FIG. 3 therefore provides a method for determining an indication of the performance across a set of nozzles, and may for example highlight effects such as where kogation is due to ramping in multipass printing or the like. This is further discussed below with reference to FIGS. 5A-D and FIG. 6.

Figure 4:
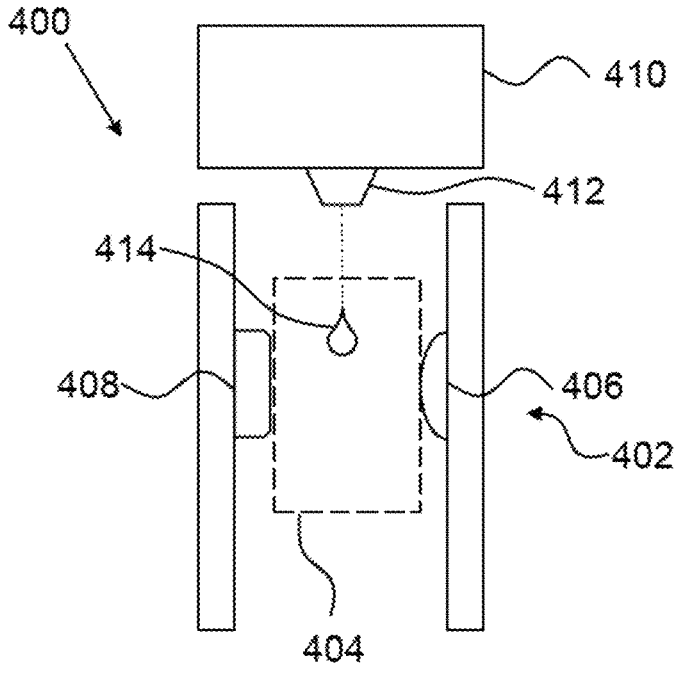
FIG. 4 is a simplified schematic of an example drop detection apparatus.

In some examples, the method may employ a drop detector. An example of a drop detector 400 is shown in FIG. 4. In this example, a plurality of drop detection units 402 (only one of which is visible in the view shown) straddle a sampling volume 404. Each drop detection unit 402 comprises a light source 406 and light detector 408. The drop detection units 402 are arranged to detect a drop passing though the sampling volume 404 between the light source 406 and the light detector 408. For example, if the light source 406 of a drop detection unit 402 is emitting light, the arrangement may be such that this light is incident on the light detector of the drop detection unit 402. A drop passing therebetween creates a shadow and the intensity of light detected by the light detector 408 decreases, allowing the presence of a drop to be detected. In some examples, the light sources 406 may comprise at least one LED (Light Emitting Diode), and/or the light detectors 408 may comprise photodiodes.

In other examples, other types of drop detector may be used, for example those based on gamma or beta ray detection, or drop detectors with a mirror which returns the radiation emitted by an emitter to a collocated receiver, or the like.

As is shown in FIG. 4, a printhead 410 may comprise a plurality of nozzles 412 (only one of which is visible in the view shown), which may each eject a drop 414. An example drop 414 may enter the sampling volume 404 at time T1. The drop 414 in this example has a 'tail' due to the way it exits a nozzle 412 (i.e. it may not be a spherical drop), which exits the sampling volume 404 at a later time T2. As the tail comprises less fluid, it may allow more light through and thus the light detected at the light detectors 408 will decrease before gradually increasing.

FIGS. 5A-D are examples of the detector signals for a plurality of nozzles (in this example, 2112 nozzles). In some examples, there may be two columns of nozzles within a printhead, which are separated by 1/1200 dpi (dots per inch) so as to achieve 1200 dpi printing. In some examples, each printhead may be associated with two different colorants, and drop detection parameters may vary between colorants (or more generally, print agents). FIGS. 5A-D represent a single column of nozzles, each nozzle contributing a vertical channel to the Figures. In other words, each FIG. 5A-D represents, as a vertical channel, the detection of a drop issued for each of 2112 nozzles by considering the output of a drop detector between a first time after the drop is ejected and a second time after the drop is ejected, which are the anticipated times for a drop having the intended size, i.e. issued from a healthy nozzle, to fall through the sampling volume 404.

Each nozzle is associated with a signal which is low (dark shading) when the body of the drop is present and high (lighter shading) when the drop is absent. Intermediate shading shows the presence of some liquid in the sampling volume, which is causing some light attenuation. The light band which can be observed after the dark band in each of FIGS. 5A-5D is an artefact of detector performance: the drop detector apparatus increases its sensitivity while the signal is low, which results in a 'high' reading when the bulk of the drop has moved through the sampling volume. The sensitivity is then adjusted down again.

Figure 5A:
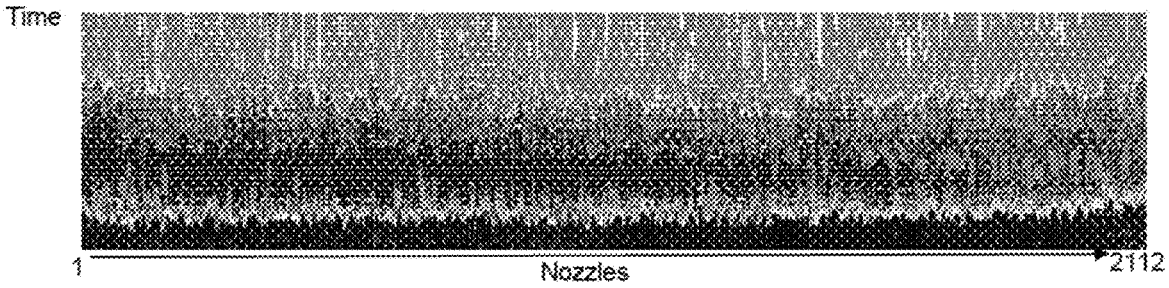
FIGS. 5A-5D show example drop detections for a plurality of nozzles.
Figure 5B:
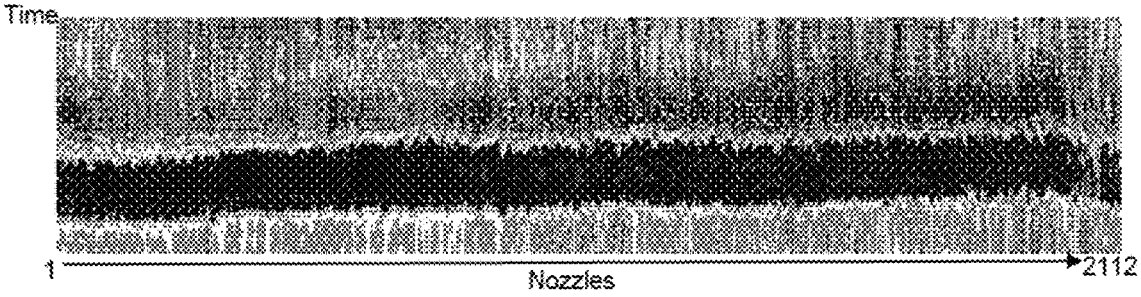
Figure 5C:
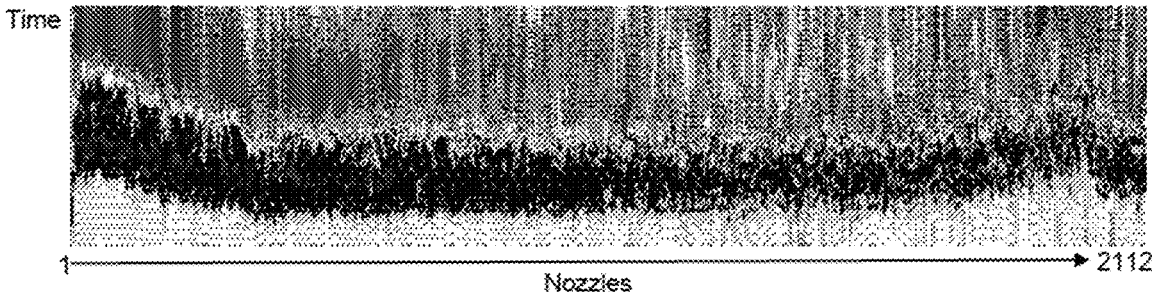
Figure 5D:
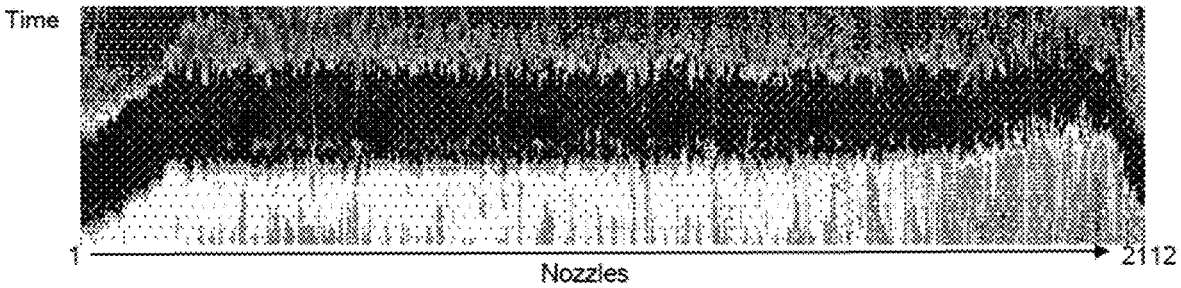

FIG. 5A shows a signal for a set of 'healthy' nozzles. The drop from each nozzle blocks the light at a corresponding time—i.e. the drops arrive in the sampling volume 404 at around the same time. FIG. 5B shows a signal in which kogation has occurred relatively uniformly across the set of nozzles. In FIGS. 5C and 5D, different levels of kogation have occurred over the set of nozzles.

As can be seen in FIG. 5A, each drop arrives early in the time frame (the dark region is aligned with a low time value), and the arrival time of the drop is roughly consistent across all nozzles. In FIG. 5B, the drops arrive later, although they are still relatively consistent across all nozzles. This may therefore be indicative of 'normal' ageing. It may be that, in some examples, as the degradation is relatively consistent, the effect on image quality is relatively low as the 'error' associated with drop size is well dispersed and the human eye tends to be drawn towards a localised error. However, the estimates of print agent usage may be incorrect for all nozzles.

In FIG. 5C, there are some localised regions in which drops are falling more slowly, and may therefore be smaller. This could create more of a visual impression. Figure D, print agent drops are falling more slowly in the centre of the nozzle array, but for that central portion have a relatively consistent speed. This may for example have more of a visual effect in print jobs in which an image extends to the edges of the printable area than print jobs which can be carried out with the central group of nozzles.

Figure 6:
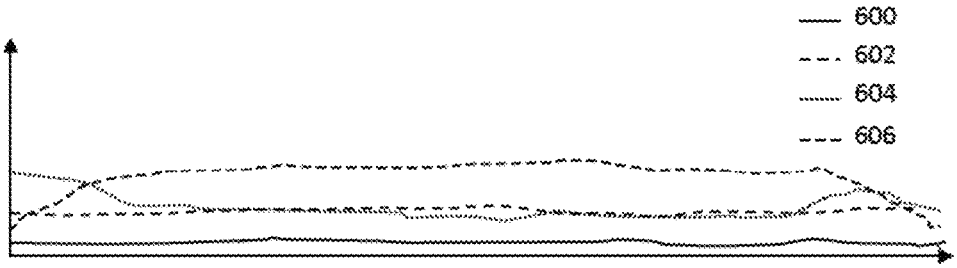
FIG. 6 shows a trace derived from the drop detections of FIGS. 5A-5D.

Data corresponding to FIG. 5A may be recorded when a printhead is new. As is shown in FIG. 6, this may be used to generate a characteristic trace 600. For example, this trace may indicate, for each nozzle, the centre point of a time at which the detected signal was below a threshold level, or may indicate the minimum signal or the like. Similar traces may be derived from FIG. 5B (trace 602), FIG. 5C (trace 604) and FIG. 5D (trace 606). These traces may be used to determine a performance parameter for a nozzle or a performance profile for the set of nozzles. In addition, a weight parameter comprising an average departure from an anticipated weight of a print agent drop may be determined. For example, considering the example of FIG. 5D, it may be derived that the reduction in velocity in the centre portion of the trace is around 20%, with some nozzles having a weight loss of around 5% and some having a drop weight loss or around 25%. The average drop weight loss may be determined to be around 18%, and this could be used to recalibrate or correct a print agent consumption estimate. More generally, based on this output, it is possible to analyse drop behaviour for each nozzle and obtain an appropriate average.

As discussed above, depending on the extent and/or the distribution of nozzle degradation, there may be different effects on image quality. For example, a variance in nozzle performance could be determined to derive a performance parameter for the set of nozzles. For example, a set of nozzles emitting drops with an estimated weight or velocity within a threshold percentage (for example, 10%) could be determined to be better performing that a set of nozzles with the same average weight drop but a greater variance. This may therefore provide a performance profile for a set of nozzles. In other examples, the variance may be determined in relation to a localised area, for example, is there a set of n adjacent nozzles having a variance of greater than x %? If so, the nozzles may perform relatively poorly for that region. In another example, if there is a set of m adjacent nozzles having a loss in velocity or weight of more than a threshold y %, this may mean that local compensation for partially blocked nozzles is not likely to succeed and again a relatively poor performance may be expected. The impact of a blocked or partially blocked nozzle on image quality may be different depending on the number of passes of the print mode used (i.e. the number of times the substrate passes under a printhead): a localized problem within the printhead may be more noticeable in a print mode in which there is a relatively low passes print modes than in a print mode in which there is a relatively high number of passes. Thus, instead of or as well as considering individual nozzle performance, the behaviour of a set of nozzles may be considered to determine a performance parameter for the set of nozzles, for example based on the performance profile. A performance profile may for example be used to derive an average weight loss, a variance or some other parameter.

Figure 7:
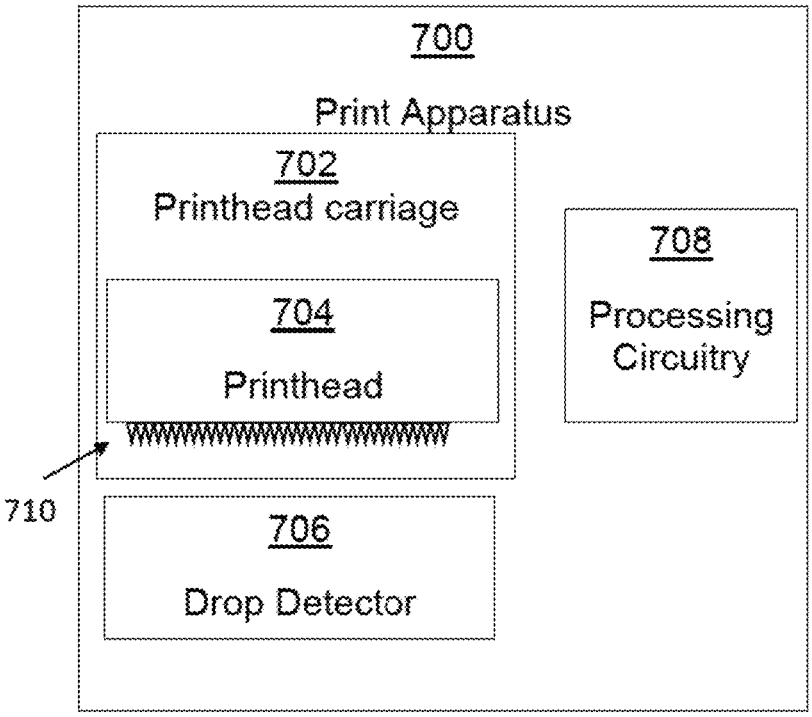
FIG. 7 is a simplified schematic of an example print apparatus.

FIG. 7 is an example of a print apparatus 700, which may be a two-dimensional or three-dimensional print apparatus, comprising a printhead carriage 702 for receiving a printhead 704, a drop detector 706 and processing circuitry 708. In this example, a printhead 704 (which may be a removable and/or replaceable component) is shown in situ in the printhead carriage 702, the printhead 704 comprising a plurality of print agent ejection nozzles 710. The drop detector 706 is to detect a drop of print agent ejected from the print agent ejection nozzles 710, and may for example comprise any drop detector, such as those mentioned above in relation to FIG. 4. The processing circuitry 708 is to receive an indication of a velocity of a drop of print agent from the drop detector 706 and to determine a weight parameter of the drop of print agent from the indication of velocity. As noted above, the weight parameter may be expressed in terms of an absolute weight, a weight difference or a velocity. For example, the processing circuitry may operate as described in relation to FIGS. 1-3 above. In some examples, the processing circuitry may determine at least one performance indicator based on the weight parameter.

Figure 8:
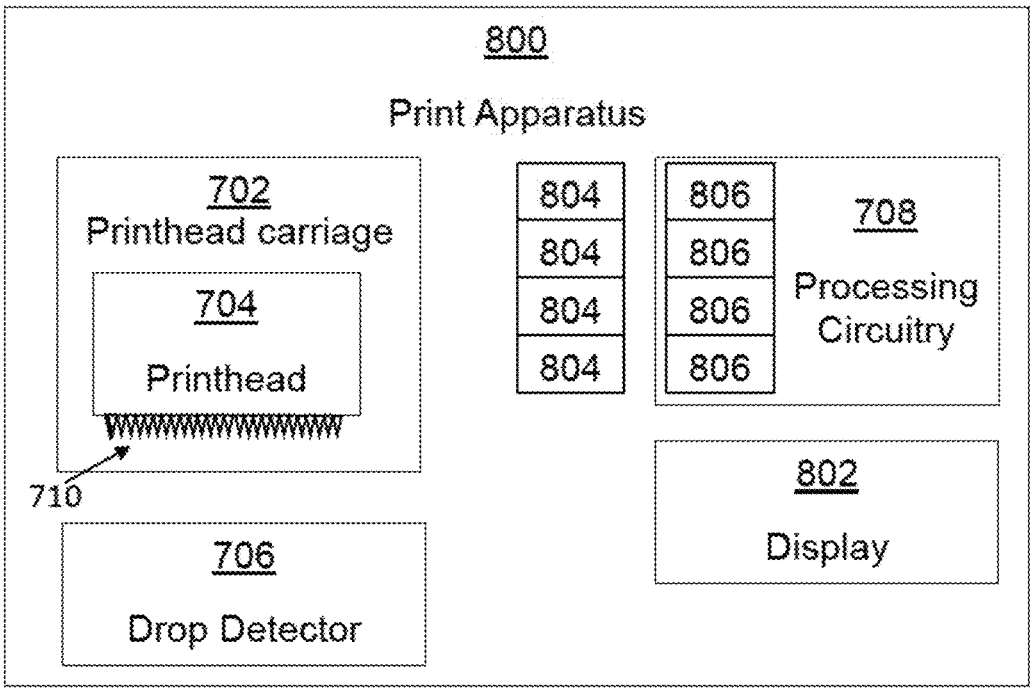
FIG. 8 is a simplified schematic of another example print apparatus.

FIG. 8 is another example of a print apparatus 800. In addition to the component described above in relation to FIG. 7, the print apparatus 800 further comprises a display 802.

The display 802 is to display the performance indicator(s). In some examples, a performance indicator may be determined for each nozzle. In some examples, determining whether kogation or partial blockage of a particular nozzle will cause an unacceptable degradation in image quality can be difficult. It can be the case that even nozzles in poor health yield reasonable overall image quality, in particular as compensating algorithms may be employed. However, in some circumstances, just a few nozzles in poor health may cause noticeable image quality defects. For a user, interpreting an image defect, and determining if the same image defect is likely to impact a different print job, is a specialised task. By providing performance indicators, for example for each nozzle of a printhead, the task may be considerably simplified. For example, nozzle score data (which may be based on drop presence and shape as well as velocity/weight) may be displayed. In some examples, this may be encoded, for example in a 'traffic lights' signal based on threshold parameter, and displayed to a user (for example through a display panel or remotely via the internet).

Display of such data may assist the user in taking decisions about printhead nozzle health and printhead replacement. It may serve to educate users, allowing them to relate nozzle scores to particular image quality issues, which may in turn reduce the printhead replacement rate. In other examples, the performance profile, which may be determined as discussed above, of a set of nozzles may be displayed.

In this example the print apparatus 800 comprises a plurality—in this example, four—print agent reservoirs 804. The processing circuitry 708 comprises four print agent quantity monitors 806, associated with each print agent reservoir 804. Each print agent quantity monitor 806 is to monitor print agent usage by the print apparatus 800 from the associated print agent reservoir 804 wherein the print agent quantity monitors 806 are to determine print agent usage based on the weight parameter.

Figure 9:
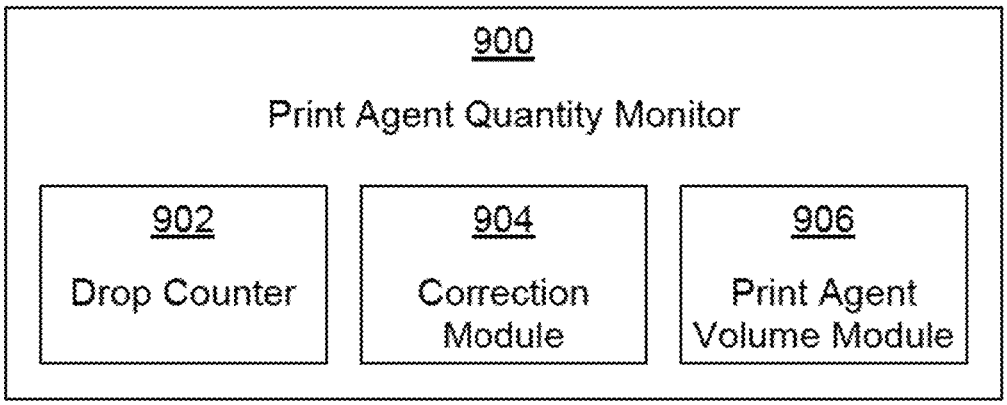
FIG. 9 is a simplified schematic of an example ink quantity monitor.

FIG. 9 is an example of a print agent quantity monitor 900. The print agent quantity monitor 900 comprises a drop counter 902 to determine a number of print agent drops dispensed by a print apparatus, a correction module 904 to determine from a difference between an anticipated arrival time of a drop at a drop detector and an actual arrival time of a drop at a drop detector (or any other measure of drop velocity), a drop weight correction factor and a print agent volume module 906 to determine, from an anticipated drop weight parameter and the drop weight correction factor, an indication of a volume of print agent dispensed. In some examples, the correction module 904 is to determine an average drop weight correction factor for a set of nozzles. In some examples, which the anticipated drop weight parameter is determined based on a print mode, i.e. the intended weight of a drop (which may be variable) is considered in determining the anticipated drop weight. In other examples, the print agent volume module 906 may determine a volume of print agent dispensed based on the drop counter 902 output and a determined weight (or average weight) for drops ejected.

The print agent quantity monitor 900 may comprise at least one processor or other processing circuitry, which may execute instructions stored on a machine readable storage medium.

Examples in the present disclosure can be provided, at least in part, as methods, systems or a combination of machine readable instructions executed by processing circuitry Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that some flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices (for example any of the processing circuitry 708, drop counter 902, correction module 904, and/or the print agent volume module 906) may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that many implementations may be designed without departing from the scope of the appended claims. Features described in relation to one example may be combined with features of another example.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. A method comprising:

ejecting a print agent drop from a printhead;

determining an indication of velocity of the print agent drop; and determining a weight parameter of the print agent drop from the indication of velocity.

2. A method according to claim 1 in which the weight parameter is a difference between an anticipated weight of the print agent drop and a determined weight of the print agent drop.

3. A method according to claim 1 further comprising determining a print agent consumption parameter from the determined weight parameter.

4. A method according to claim 1 comprising determining a performance parameter for a nozzle of the printhead based on the indication of velocity.

5. A method according to claim 1 comprising:

ejecting a plurality of print agent drops, each print agent drop being ejected from a nozzle of a set of nozzles of a printhead; and determining, for each print agent drop, an indication of velocity.

6. A method according to claim 5 comprising determining a performance profile for the set of nozzles based on the indications of velocity.

7. A method according to claim 5 comprising determining, for the set of nozzles, a weight parameter comprising an average departure from an anticipated weight of a print agent drop.

8. A method according to claim 1 in which determining the indication of velocity of the print agent drop comprises determining a time of arrival for the print agent drop at a sampling volume.

9. A method according to claim 1 further comprising monitoring print agent usage by determining print agent usage based on the weight parameter.

10. A print apparatus comprising:

a printhead carriage to receive a printhead comprising a print agent ejection nozzle;

a drop detector to detect a drop of print agent ejected from the print agent ejection nozzle; and processing circuitry to receive an indication of velocity of a drop of print agent from the drop detector and to determine a weight parameter of the drop of print agent from the indication of velocity.

11. A print apparatus according to claim 10 in which the processing circuitry is to determine a performance indicator based on the weight parameter.

12. A print apparatus according to claim 11 further comprising a display, wherein the display is to display the performance indicator.

13. A print apparatus according to claim 10 in which the processing circuitry comprises a print agent quantity monitor to monitor print agent usage by the print apparatus, wherein the print agent quantity monitor is to determine print agent usage based on the weight parameter.

14. A print apparatus according to claim 13 comprising a plurality of print agent reservoirs, and further comprising a plurality of print agent quantity monitors, wherein a print agent quantity monitor is associated with each print agent reservoir.

15. A print apparatus according to claim 10 further comprising a look up table to provide the weight parameter of the drop of print agent from the indication of the velocity of the drop of print agent.

16. A print apparatus according to claim 11 in which the performance indicator is an indication of nozzle kogation in the printhead.

17. A print apparatus according to claim 10 further comprising:

a drop counter to determine a number of print agent drops dispensed;

a correction module to determine, from a drop velocity, a drop weight correction factor; and a print agent volume module to determine, from an anticipated drop weight parameter and the drop weight correction factor, an indication of a volume of print agent dispensed.

18. A print agent quantity monitor comprising:

a drop counter to determine a number of print agent drops dispensed by a print apparatus;

a correction module, to determine, from a drop velocity, a drop weight correction factor; and a print agent volume module to determine, from an anticipated drop weight parameter and the drop weight correction factor, an indication of a volume of print agent dispensed.

19. The print agent quantity monitor of claim 18 in which the correction module is to determine an average drop weight correction factor for a set of nozzles.

20. The print agent quantity monitor of claim 18 in which the anticipated drop weight parameter is determined based on a print mode.

* * * * *